US011019866B2

(12) United States Patent
Reno

(10) Patent No.: US 11,019,866 B2
(45) Date of Patent: Jun. 1, 2021

(54) SAMURAI WRAP

(71) Applicant: Latoya Reno, Ocoee, FL (US)

(72) Inventor: Latoya Reno, Ocoee, FL (US)

( * ) Notice: Subject to any disclaimer, the term of this patent is extended or adjusted under 35 U.S.C. 154(b) by 29 days.

(21) Appl. No.: 16/251,297

(22) Filed: Jan. 18, 2019

(65) Prior Publication Data

US 2019/0223533 A1 Jul. 25, 2019

Related U.S. Application Data

(60) Provisional application No. 62/618,796, filed on Jan. 18, 2018.

(51) Int. Cl.

| | |
|---|---|
| ***A42B 1/041*** | (2021.01) |
| ***A42B 7/00*** | (2006.01) |
| ***A41D 23/00*** | (2006.01) |
| ***A42B 1/004*** | (2021.01) |
| ***A42B 1/04*** | (2021.01) |

(52) U.S. Cl.

CPC ..... *A42B 1/04* (2013.01); *A41D 23/00* (2013.01); *A42B 1/004* (2013.01); *A42B 1/041* (2013.01); *A42B 7/00* (2013.01)

(58) Field of Classification Search

CPC ..... A42B 1/041; A42B 1/004; A42B 1/04; A42B 1/003; A42B 7/00; A41D 23/00

USPC ..... D2/500, 878, 881, 885, 891

See application file for complete search history.

(56) References Cited

U.S. PATENT DOCUMENTS

| | | | | |
|---|---|---|---|---|
| RE18,081 E * | 5/1931 | Lipper | ..... | A42B 1/041 2/195.8 |
| 2,279,867 A * | 4/1942 | Falk | ..... | A42B 1/041 132/274 |
| 5,878,756 A * | 3/1999 | Bilodeau | ..... | A42B 1/041 132/212 |
| 9,138,025 B1 * | 9/2015 | Lunsford | ..... | A42B 1/041 |
| 2017/0265553 A1 * | 9/2017 | Bryson | ..... | A42B 1/225 |

OTHER PUBLICATIONS

LP Share, "Use Leggings as a Head Wrap ~ Requested;" https://www.youtube.com/watch?v=CpHYNphrVgc; published on Oct. 10, 2015; accessed on Jun. 17, 2020. (Year: 2015).*

* cited by examiner

*Primary Examiner* — Daniel J Colilla

(57) ABSTRACT

A head covering garment sheathing the hair. The head covering consists of a cap, two sleeves, a latch and an ornamental object. The cap portion is fitted, and the two attached sleeves are elongated and one and a half inch apart, allowing the user to wrap the sleeves in a crisscross pattern around the perimeter of the head. An ornamental object, which is optionally removable and interchangeable, is located at the end of one of the two sleeves. A "U" shaped latch is located at the end of the other sleeve and is an adjustable and retractable opening, allowing for the ornamental object to pass through, which secures the sleeves in place.

9 Claims, 4 Drawing Sheets

SAMURAI WRAP

TECHNICAL FIELD

The invention relates to the field of head coverings. Specifically, it is related to head coverings that protect the hair.

BACKGROUND ART

There are various types of head coverings. Several examples include head wraps, caps, hats, beanies, bonnets, headscarves, burkas, turbans, etc. These head coverings are made of different types of materials and worn for many reasons, including enhancing a particular style, protecting hair, hiding unattractive or unmanageable hair, etc.

SUMMARY OF INVENTION

The invention is a head covering garment that sheathes the hair on the user's head in its entirety. The cap portion covers the head from the perimeter of the head to the end of the nape. The two elongated sleeves separate and encase the hair that extends from the head. After wrapping around the head, the sleeves are held into place when the attached ornamental object, located on one sleeve, is pushed through an adjustable and retractable "U" shaped latch, located on the opposite sleeve.

Hair protection and preservation is the core functionality of the head covering. The head covering, which can accommodate up to 26 inches of hair, can be worn while sleeping and is lined with a satin or silk lining. This lining protects the hair from drying out and frizzing. Additionally, the invention protects the hair from outdoor elements.

However, in addition to its protective function, the head covering can be worn as a fashion accessory due to its aesthetic elements. Specifically, the head covering comes in a variety of colors, the exterior fabric is lace, and the end of one sleeve has an attached ornamental object. These fashionable properties allow the user to wear the head covering while running errands or participating in social activities.

The head covering is also water resistant and washable, allowing for reuse.

BEST MODE FOR CARRYING OUT THE INVENTION

Figure 1:
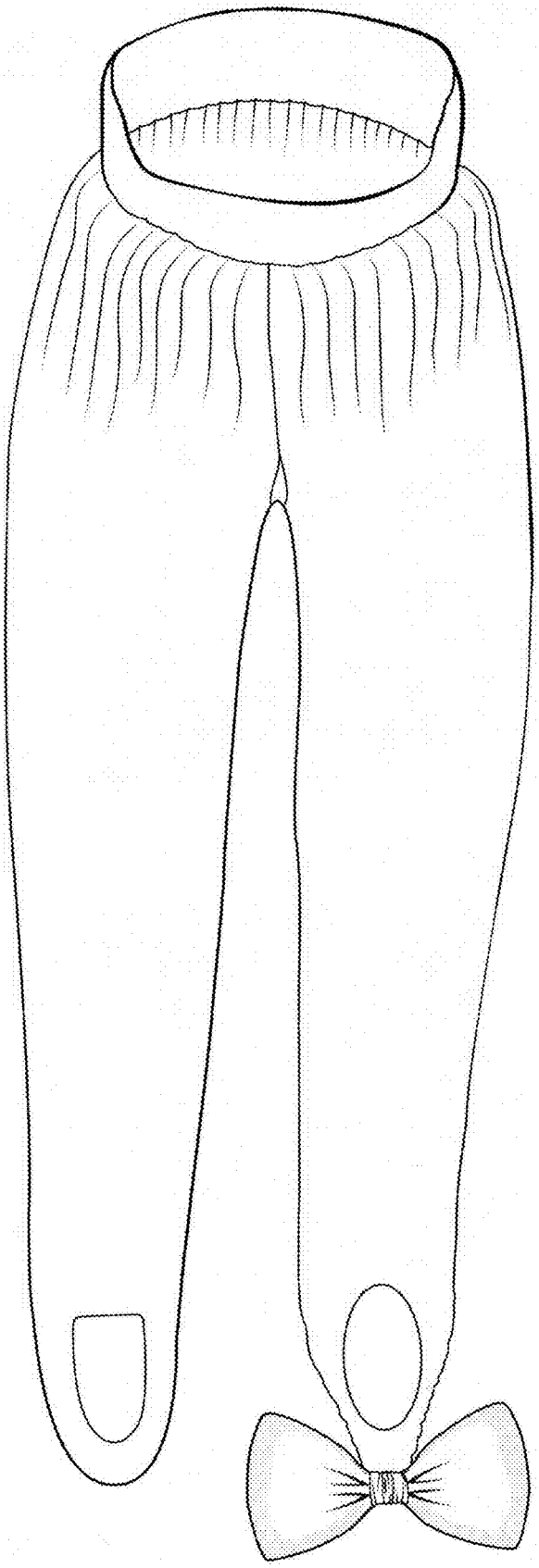
FIG. 1 shows the head covering garment in an unwrapped state.
Figure 2:
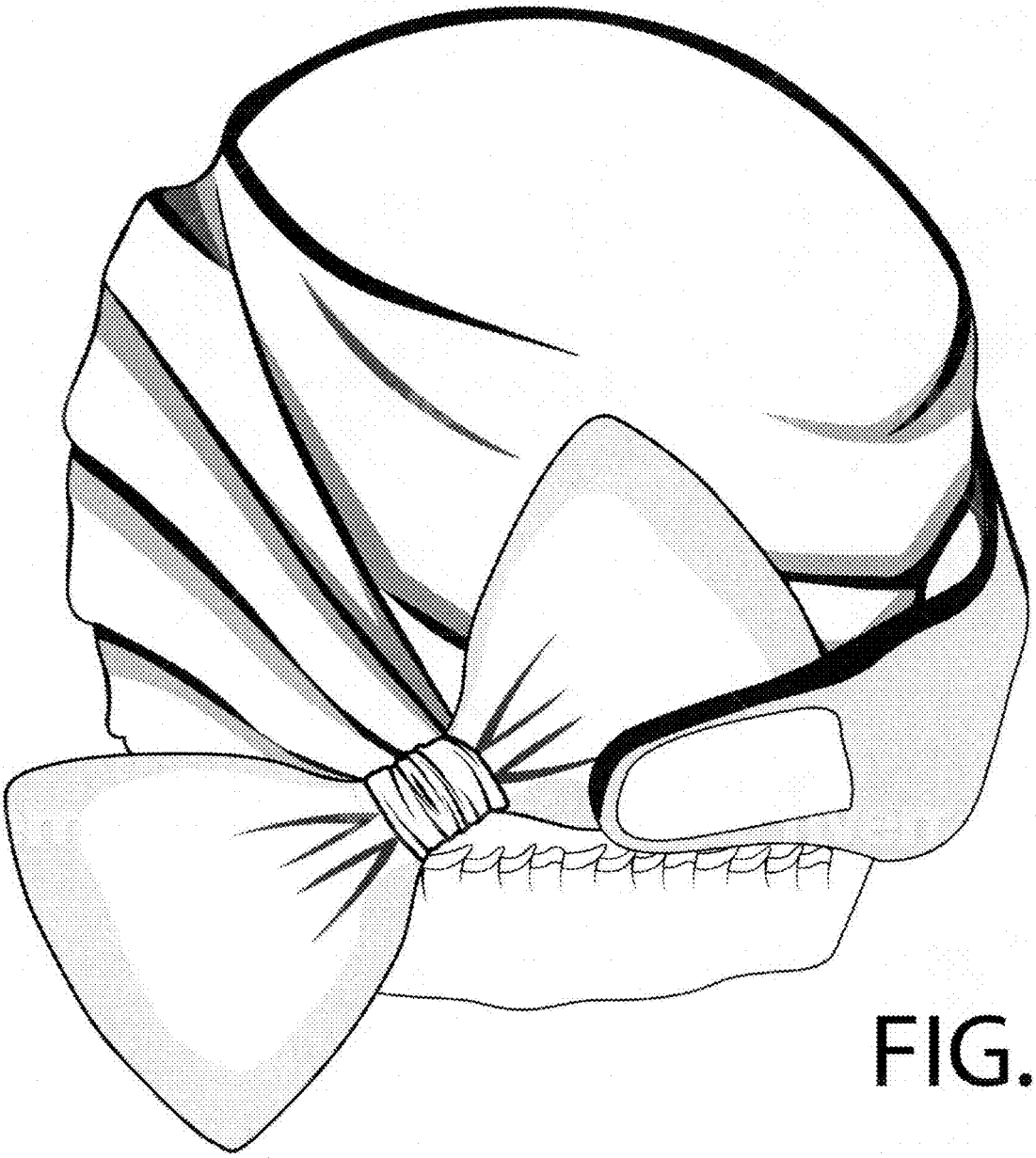
FIG. 2 shows the head covering garment in a wrapped state with the ends of the sleeves not yet attached.
Figure 3:
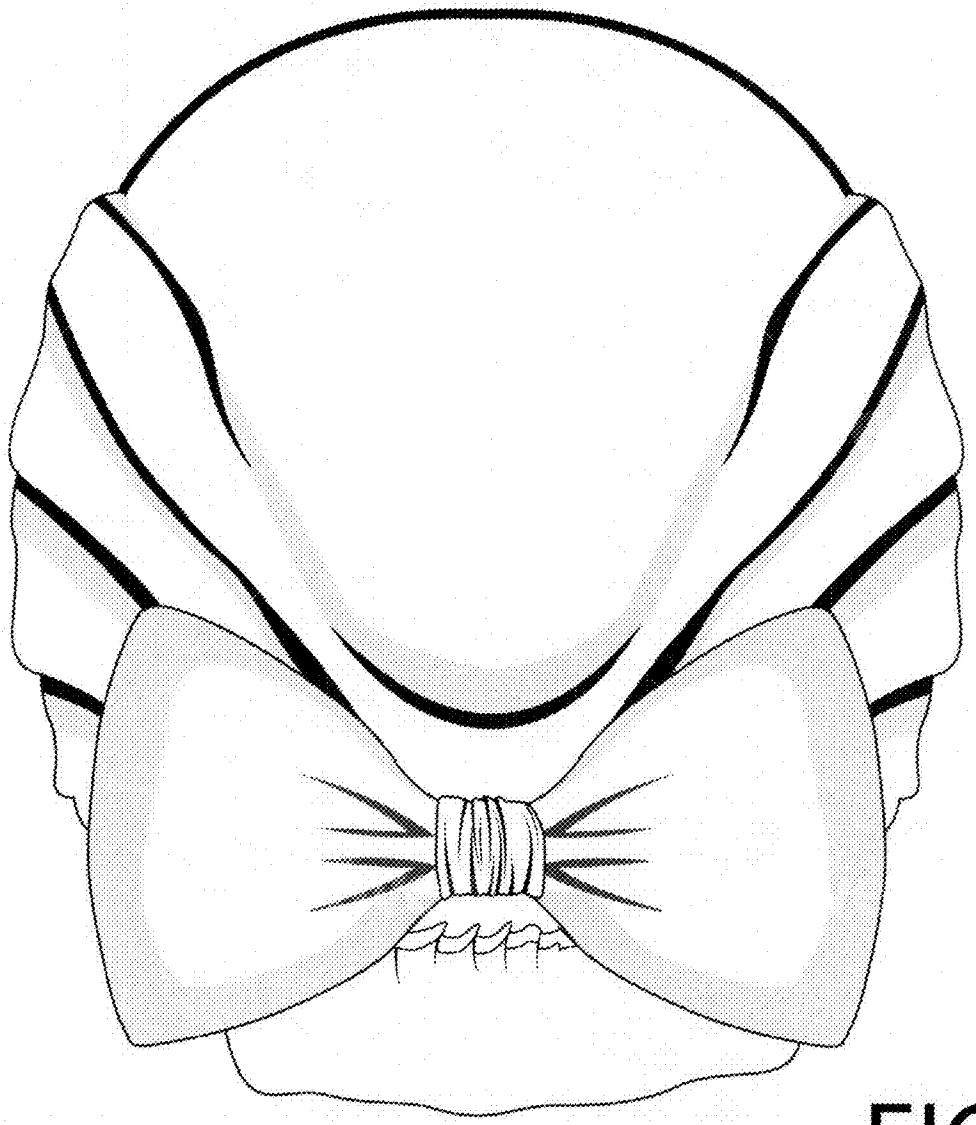
FIG. 3 shows the head covering garment in a wrapped state with the ends of the sleeves attached.
Figure 4:
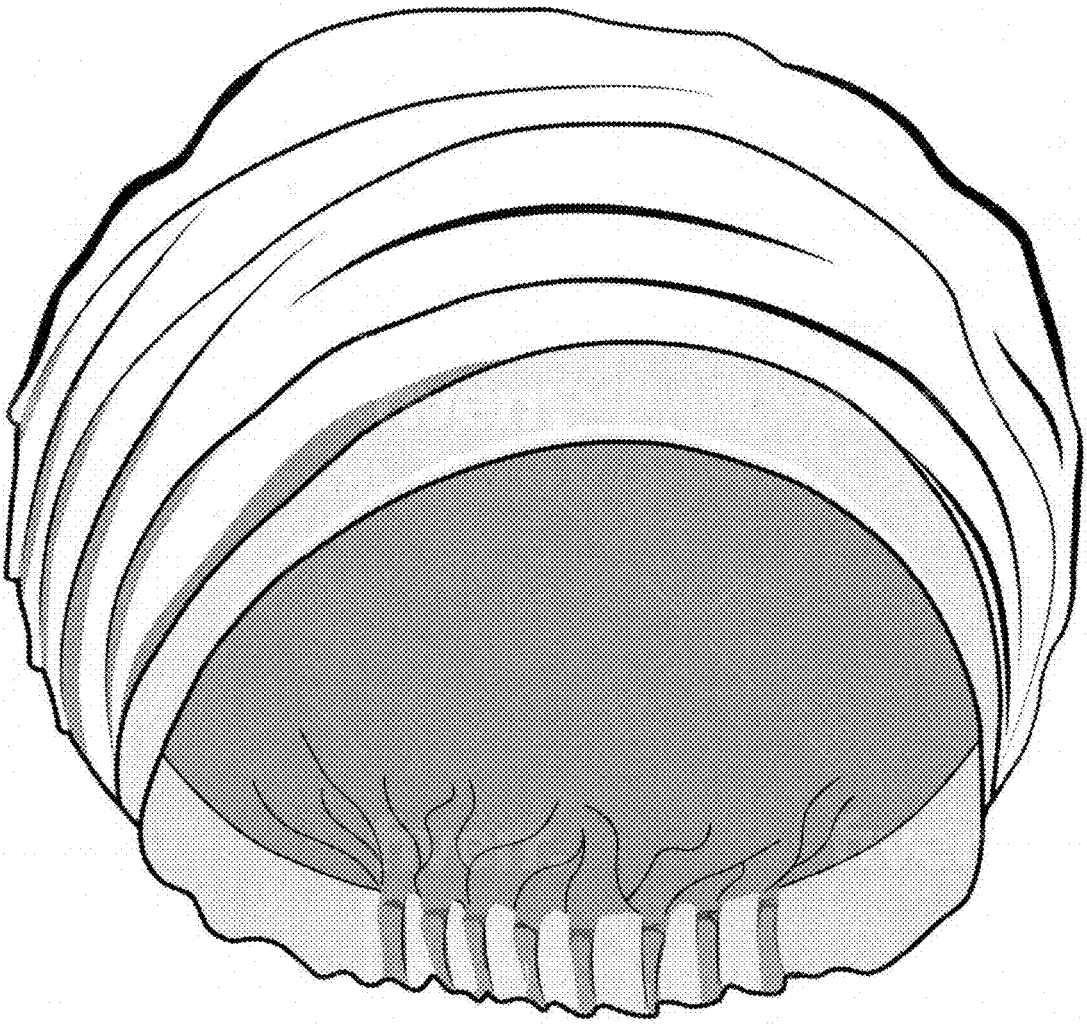
FIG. 4 shows an embodiment of the head covering garment including an adjustable elastic band.

The best mode for carrying out the invention is illustrated via a description of the embodiments provided herein.

The invention is a head covering garment that sheathes the hair on the user's head in its entirety. The cap portion covers the head, from the perimeter to the end of the nape. The elongated sleeves enclose the hair that extends from the head. Additionally, the sleeves are wrapped around the head and held into place once the ornamental object, located on one sleeve, is pushed through the "U" shaped adjustable and retractable latch, located on the opposite sleeve.

The following are the general steps for putting on and/or using the invention: 1) Push each arm through the sleeves (starting at the ends) until the hands reach the cap portion 2) Place the cap portion on the head while simultaneously pulling an even distribution of hair through each sleeve 3) once the hair is pulled through the sleeves, adjust the cap portion to ensure both the perimeter and nape are covered 4) Crisscross the sleeves at the nape 5) Pull the sleeves up to the front of the head 6) Crisscross the sleeves at the front of the head 7) Bring the sleeves back down to the nape 8) Secure into place by pushing the ornamental object located at the end of one sleeve through the adjustable and retractable "U" shaped latch located at the end of the other sleeve.

The head covering can accommodate hair lengths up to 26 inches, allowing users with varying hair lengths to use the garment. The invention can also be made with an adjustable elastic band, allowing for a more comfortable and secure fit.

The core functionality of the heading covering garment is to protect and preserve the hair. The interior of the cap portion and sleeves are lined with silk or satin material, which prevents the hair from drying out and frizzing—especially when sleeping. The heading covering also protects the hair from outdoor elements, including wind and rain.

The head covering may also be infused with oils, which not only adds another protective element but also nutrients and added moisture for the hair.

In addition to its protective functionality, the heading cover can also be worn for fashion purposes. It comes in varying colors and the exterior fabric is lace. Also, the ornamental object, located at the end of one of the sleeves, can be a bow, flower, butterfly, heart, eye, puff or a charm. The object can be permanently attached to a sleeve or the heading covering can be made to allow the ornamental object to be removable and interchangeable. These aesthetic elements offer the user the opportunity to wear the head covering while running errands or while participating in social activities.

The fabrics used to make the head covering are stretchable, which allows the user to more easily put on the head covering. The fabrics are also water resistant and washable, allowing the user to reuse the head covering multiple times.

What is claimed is:

1. A head covering garment for sheathing the hair, consisting of the following:

a.) a main body forming a fitted cap with an interior fabric and an exterior fabric;

b.) two elongated sleeves attached on the cap portion, including a first and a second sleeve, stitched one and a half inch apart, and both with an interior fabric and an exterior fabric, wherein the two elongated sleeves are each configured to separate and encase hair from a head of a user, and the two elongated sleeves are configured to be wrapped around the head of the user;

c.) a "U" shaped latch located at the end of the first sleeve; and d.) an ornamental object located at the end of the second sleeve, wherein the ornamental object is configured to be pushed through the "U" shaped latch in order to hold the two elongated sleeves in place after they are wrapped around the head of the user.

2. The head covering garment recited by claim 1, wherein said exterior fabric is made of lace.

3. The head covering garment recited by claim 1, wherein said interior fabric is satin, silk or stretch silk fabric.

4. The head covering garment recited by claim 1, wherein said interior fabric and said exterior fabric are water resistant and washable.

5. The head covering garment recited by claim 1, wherein said interior fabric is optionally oil infused.

6. The head covering garment recited by claim 1, wherein the cap has an optional adjustable elastic band.

7. The head covering garment recited by claim 1, wherein said "U" shaped latch includes an adjustable and retractable opening.

8. The head covering garment recited by claim 1, wherein said ornamental object is a bow, flower, butterfly, heart, eye, puff, or a charm.

9. The head covering garment recited by claim 1, wherein said ornamental object is optionally removable and interchangeable.

* * * * *